US012372318B2

(12) United States Patent
Smathers

(10) Patent No.: US 12,372,318 B2
(45) **Date of Patent: *Jul. 29, 2025**

(54) TRIGGER SHOE ASSEMBLY

(71) Applicant: OA DEFENSE LLC, Dayton, NV (US)

(72) Inventor: Joseph Smathers, Dayton, NV (US)

(73) Assignee: OA DEFENSE LLC, Dayton, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/228,405

(22) Filed: Jul. 31, 2023

(65) Prior Publication Data

US 2024/0035769 A1 Feb. 1, 2024

Related U.S. Application Data

(60) Provisional application No. 63/393,453, filed on Jul. 29, 2022.

(51) Int. Cl.

| | |
|---|---|
| ***F41A 19/10*** | (2006.01) |
| ***F41A 5/02*** | (2006.01) |
| ***F41A 17/46*** | (2006.01) |
| ***F41A 19/15*** | (2006.01) |
| ***F41A 19/16*** | (2006.01) |

(52) U.S. Cl.

CPC ..... *F41A 19/10* (2013.01); *F41A 17/46* (2013.01); *F41A 19/15* (2013.01); *F41A 19/16* (2013.01); *F41A 5/02* (2013.01)

(58) Field of Classification Search

CPC ..... F41A 9/10
USPC ..... 42/69.01–69.02
See application file for complete search history.

(56) References Cited

U.S. PATENT DOCUMENTS

| | | | | |
|---|---|---|---|---|
| 984,519 | A | 2/1911 | Browning | |
| 2,404,118 | A * | 7/1946 | Yawman | B21D 53/00 42/69.01 |
| 3,365,829 | A | 1/1968 | Shockey | |
| 3,682,040 | A | 8/1972 | Roy | |
| 4,023,296 | A | 5/1977 | Frisoli | |
| 4,338,740 | A | 7/1982 | Miller | |
| 4,539,770 | A | 9/1985 | Bornancini | |
| 4,593,487 | A | 6/1986 | Ruger | |
| 4,709,497 | A | 12/1987 | Resca | |
| 5,822,903 | A * | 10/1998 | Davis, Sr. | F41A 19/16 42/70.07 |
| 6,116,137 | A | 9/2000 | Strahan | |
| 6,205,694 | B1 | 3/2001 | Davis | |
| 9,068,790 | B2 | 6/2015 | La Vigne | |
| 10,000,000 | B2 | 6/2018 | Holton | |
| 10,794,648 | B2 | 10/2020 | Henninger et al. | |
| 11,248,869 | B2 * | 2/2022 | Lopata | F41A 19/10 |
| 11,719,499 | B1 * | 8/2023 | Hynds | F41A 19/16 42/69.01 |

(Continued)

FOREIGN PATENT DOCUMENTS

WO 20180102458 A2 6/2018

OTHER PUBLICATIONS

International Search Report and Written Opinion dated Oct. 19, 2023 issued in PCT/US2023/29136.

(Continued)

*Primary Examiner* — Reginald S Tillman, Jr.
(74) *Attorney, Agent, or Firm* — HUNTON ANDREWS KURTH LLP

(57) ABSTRACT

Trigger assembly with a trigger shoe, a trigger bow, and a set screw.

20 Claims, 4 Drawing Sheets

(56) References Cited

U.S. PATENT DOCUMENTS

| | | | | |
|---|---|---|---|---|
| 12,007,199 | B2 * | 6/2024 | Smathers | F41C 23/10 |
| 2013/0269233 | A1 * | 10/2013 | Chin | F41A 19/15<br>42/69.01 |
| 2019/0041150 | A1 | 2/2019 | Lopata et al. | |
| 2019/0137206 | A1 * | 5/2019 | Lopata | F41A 19/10 |
| 2020/0025501 | A1 | 1/2020 | Price | |
| 2021/0131764 | A1 | 5/2021 | Padovan | |

OTHER PUBLICATIONS

Notification Concerning Transmittal of Copy of International Preliminary Report on Patentability from related PCT Application No. PCT/US2023/029136, mailed Feb. 4, 2025, 13 pages.

* cited by examiner

TRIGGER SHOE ASSEMBLY

CROSS-REFERENCE TO RELATION APPLICATIONS

This application claims priority to U.S. Provisional Application No. 63/393,453 filed Jul. 29, 2022, which application is incorporated by reference herein. This application also relates to U.S. Pat. No. 984,519 filed on Feb. 17, 1910, the contents of which are incorporated herein in its entirety.

FIELD OF THE DISCLOSURE

The present invention relates generally to firearms. More specifically, the present invention is concerned with an improved single-action, recoil-operated, semi-automatic pistol.

BACKGROUND

Hand pistols taught by U.S. Pat. No. 984,519, or some variation thereof, (each a "1911") have been in production for over one-hundred years. During that time, the 1911 has developed a loyal following for a variety of reasons. Unfortunately, certain features of the 1911 are not optimized. Accordingly, it would be beneficial to have a firearm that is capable of satisfying 1911 loyalists while improving upon certain non-optimized features.

A traditional 1911 is configured to receive a magazine within a magazine well. As the magazine is inserted into the magazine well, it is guided through a trigger bow. Traditional 1911 trigger bows are swaged with a trigger shoe, thereby forming a trigger shoe assembly. The trigger shoe assembly is then installed on the firearm by inserting the trigger shoe assembly through a back opening of the magazine well and translating the trigger shoe assembly through the magazine well until the trigger shoe extends through a front opening of the magazine well, thereby forming a trigger cavity between the trigger shoe and the magazine well. Although the traditional 1911 assembly process and engagement feature is satisfactory in certain situations, it would be beneficial to have an alternative assembly process and engagement feature.

Adjustment of certain features of a 1911 are also not optimum. For instance, adjusting traditional trigger shoe assemblies often requires removing the assembly from the firearm, which first requires complete disassembly of the firearm. Accordingly, it would be beneficial to have a system for and a method of adjusting a trigger shoe assembly without requiring removal of the trigger shoe assembly from the firearm and/or otherwise not requiring complete disassembly of the firearm.

SUMMARY OF THE DISCLOSURE

In some aspects, the techniques described herein relate to a firearm including: a slide assembly; a barrel; a frame; and a trigger shoe assembly including: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

In some aspects, the techniques described herein relate to a firearm including: a frame; and a trigger shoe assembly operably connected to the frame, wherein the trigger shoe assembly includes: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

In some aspects, the techniques described herein relate to a trigger shoe assembly including: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

Further features of the disclosed systems and methods, and the advantages offered thereby, are explained in greater detail hereinafter with reference to specific example embodiments illustrated in the accompanying drawings.

BRIEF DESCRIPTION OF THE DRAWINGS

In order to facilitate a fuller understanding of the present invention, reference is now made to the attached drawings. The drawings should not be construed as limiting the present invention, but are intended only to illustrate different aspects and embodiments of the invention.

DETAILED DESCRIPTION

Figure 1A:
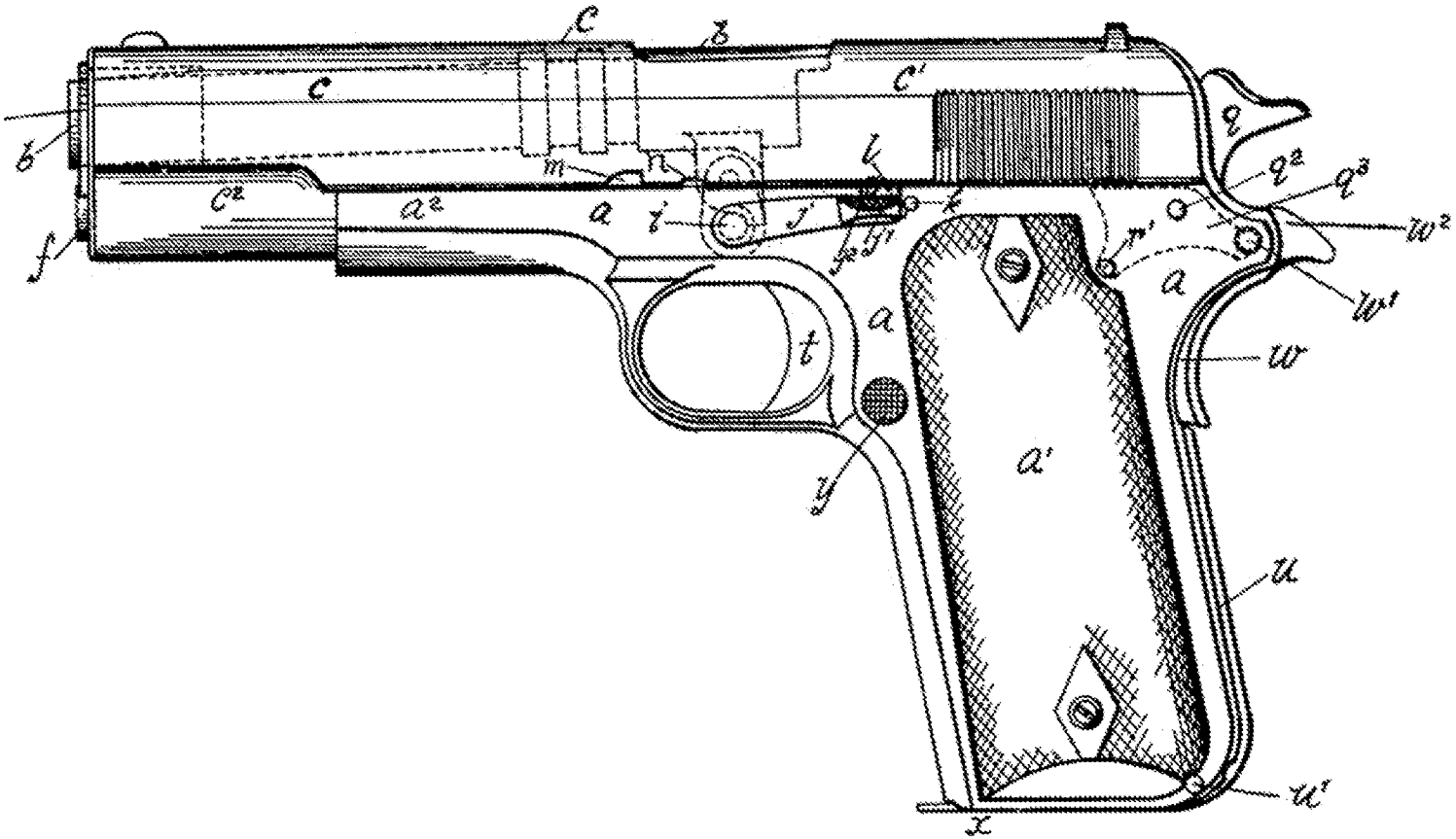
FIGS. 1A and 1B illustrate a 1911 pistol.

Exemplary embodiments of the invention will now be described in order to illustrate various features of the invention. The embodiments described herein are not intended to be limiting as to the scope of the invention, but rather are intended to provide examples of the components, use, and operation of the invention.

Furthermore, the described features, advantages, and characteristics of the embodiments may be combined in any suitable manner. One skilled in the relevant art will recognize that the embodiments may be practiced without one or more of the specific features or advantages of an embodiment. In other instances, additional features and advantages may be recognized in certain embodiments that may not be present in all embodiments.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The present invention comprises a modified 1911 hand pistol (the "2311"). The 2311 is similar enough to a 1911 to satisfy most loyalists, while resolving certain deficiencies associated with the 1911.

Like the 1911, the 2311 utilizes a trigger bow that extends around a magazine inserted into a magazine well. Unlike the 1911, the 2311 trigger bow dovetails with the 2311 trigger shoe, thereby providing superior engagement over traditional swaging of the components. The trigger shoe assembly of the 2311 further includes a set screw extending vertically through a top rear portion of the trigger shoe so as to bias a front tab of the trigger bow into full engagement with the trigger shoe. The trigger shoe and trigger bow further include corresponding lips that are configured to interlock when the front tab of the trigger bow is in full engagement with the trigger shoe. In this way, the robust joint of the 2311 trigger shoe assembly provides more assembly and adjustment possibilities than are available for a traditional 1911 trigger shoe assembly.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

FIG. 1A is side view of a hand pistol of the prior art, the image taken from U.S. Pat. No. 984,519 (FIG. 1), the pistol shown in a rest configuration.

Figure 1B:
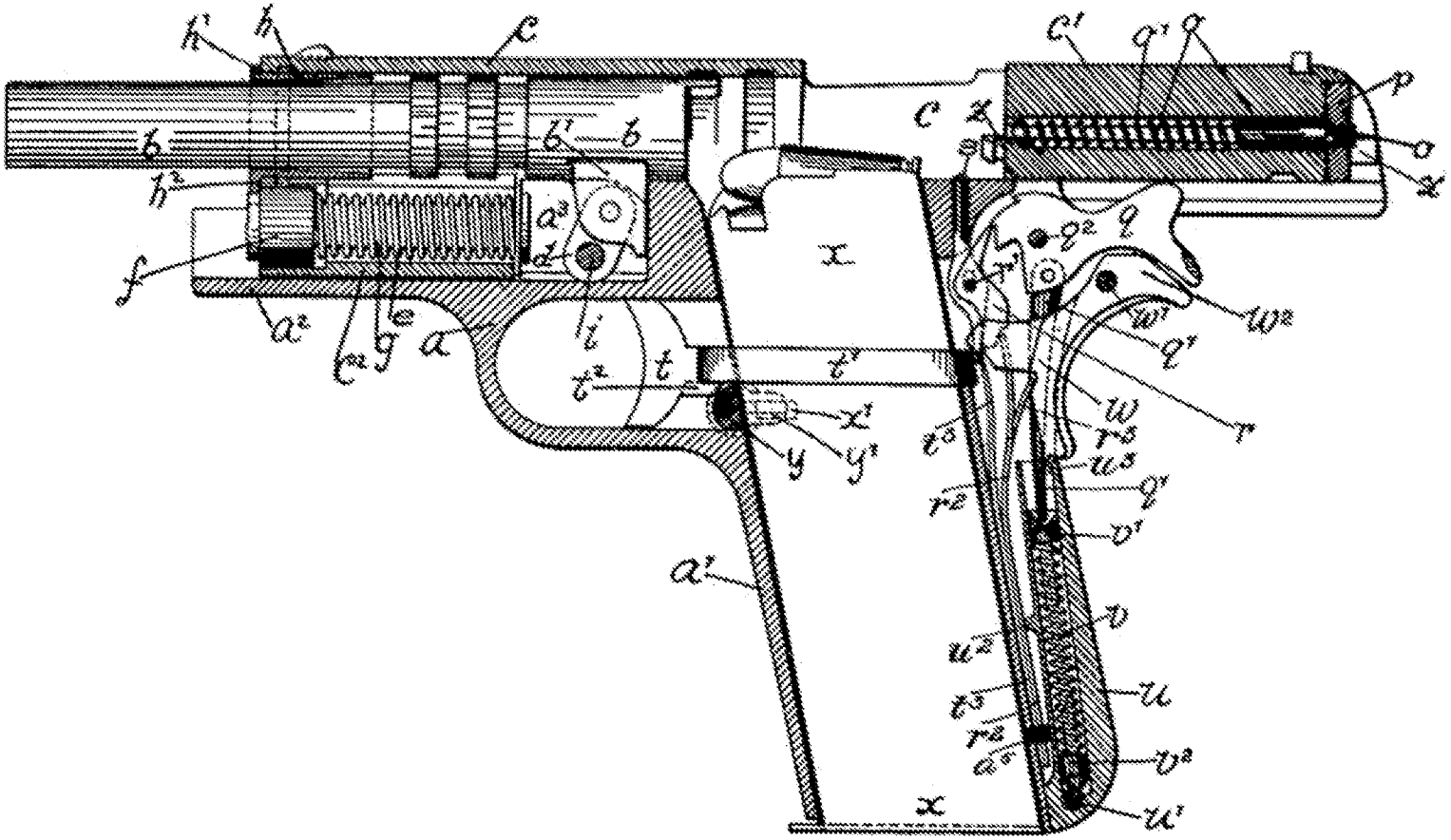
Figure 2A:
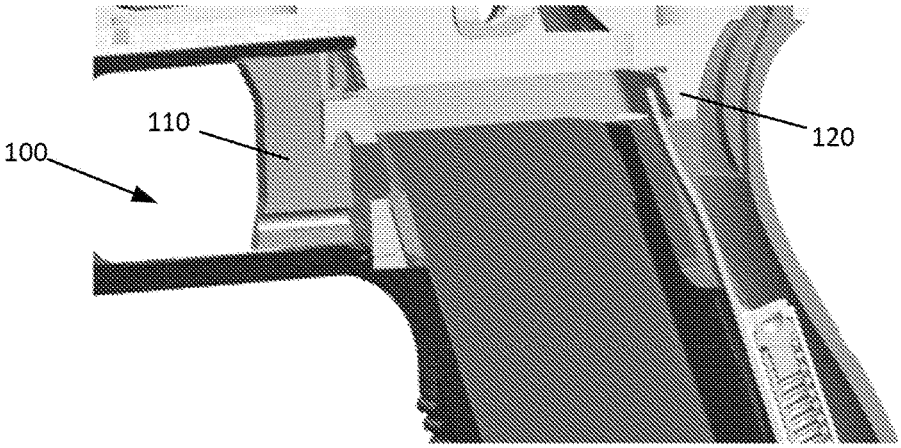
FIGS. 2A-2F illustrate a firearm according to an exemplary embodiment.
Figure 2B:
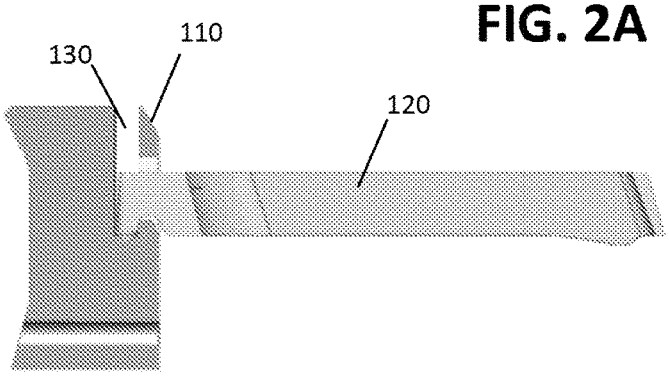
Figure 2C:
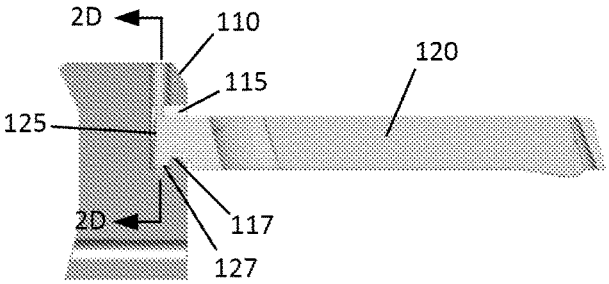
Figure 2D:
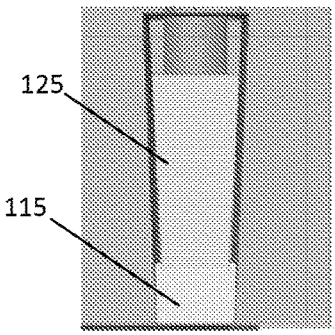
Figure 2E:
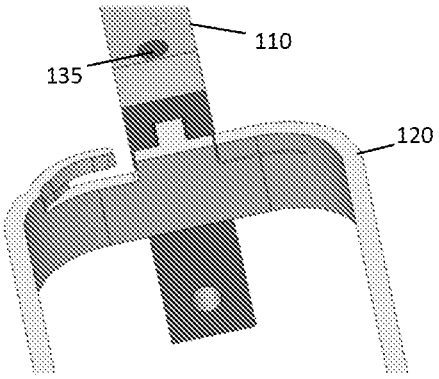
Figure 2F:
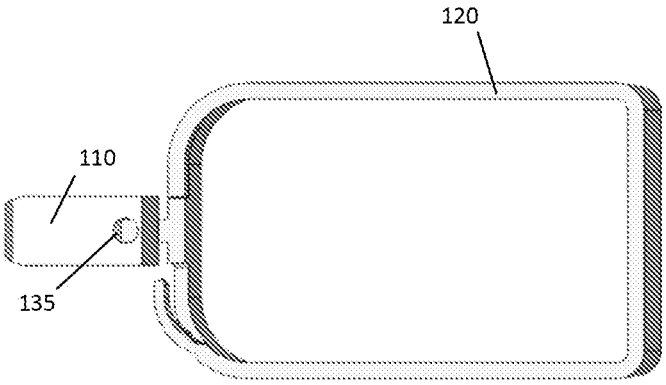

FIG. 1B shows the pistol of FIG. 1A in a loading configuration, a portion of the pistol removed to show internal components thereof.

Referring to FIGS. 2A-2F, an improved firearm embodiment incorporates a trigger shoe assembly 100, comprising a trigger shoe 110 and a trigger bow 120, providing enhanced functionality and adjustability. The trigger shoe 110 includes a back portion that features a rear channel 115 specifically designed to accommodate a front tab 125 of the trigger bow 120. The front tab 125 and rear channel 115 exhibit corresponding angled surfaces, optimizing the alignment and facilitating a secure seating of the front tab 125 within the rear channel 115. This configuration ensures reliable and consistent engagement between the trigger shoe 110 and the trigger bow 120 during firearm operation To further enhance the connection between the trigger shoe 110 and the trigger bow 120, the rear channel 115 terminates at a lip 117 that is configured to engage with a notch 127 present on the front tab 125. The interaction between the lip 117 and the notch 127 provides a robust and stable connection, thereby fully engaging the trigger shoe 110 with the trigger bow 120. This ensures that the trigger shoe assembly 100 remains securely in place during firing and handling of the firearm.

In addition to the above features, the trigger shoe assembly 100 incorporates a set screw 130, which plays a crucial role in biasing the trigger bow 120 into full engagement with the trigger shoe 110. The set screw 130 is positioned within a screw cavity 135, allowing for precise adjustment of the trigger shoe assembly. In certain embodiments, the set screw 130 extends vertically through a top rear portion of the trigger shoe 110, making contact with a top portion of the front tab 125 of the trigger bow 120. This contact point allows for the application of controlled pressure, ensuring a consistent and optimal engagement between the trigger shoe 110 and the trigger bow 120.

To facilitate convenient and efficient adjustment of the trigger shoe assembly 100, particularly in terms of the set screw 130, the firearm is designed such that the set screw 130 is accessible from the top of the firearm when the slide is removed. This arrangement enables shooters to make precise adjustments to the trigger shoe assembly without the need for complete disassembly of the firearm. By simply removing the slide, the set screw 130 becomes readily accessible, allowing for easy modification of the trigger shoe assembly to suit individual preferences or specific shooting requirements.

It should be noted that various modifications and variations can be implemented in the described trigger shoe assembly. For instance, the shape, size, and materials of the trigger shoe 110 and trigger bow 120 can be adapted to accommodate different firearm models or shooter preferences. Additionally, the specific configuration and dimensions of the rear channel 115, front tab 125, lip 117, notch 127, set screw 130, and screw cavity 135 can be adjusted as needed to achieve optimal performance and ease of adjustment.

The trigger shoe assembly and its components can be fabricated from a variety of materials to meet specific requirements such as strength, durability, weight, and cost considerations. Commonly used materials include steel, aluminum alloys, and various metals known for their structural integrity and resistance to wear. These metal-based materials provide robustness and longevity to withstand the forces exerted during firearm operation. Additionally, polymers or polymer blends are often employed in trigger shoe assemblies, offering benefits such as lightweight construction, cost-effectiveness, and the ability to be molded into intricate shapes for ergonomic design. Carbon fiber, known for its high strength-to-weight ratio, may also be utilized to create lightweight and rigid trigger shoe assemblies, catering to shooters seeking optimal performance and reduced weight. The choice of material for the trigger shoe assembly and its parts ultimately depends on the desired balance of factors such as strength, weight, cost, and design considerations for the specific firearm application.

In some aspects, the techniques described herein relate to a firearm including: a slide assembly; a barrel; a frame; and a trigger shoe assembly including: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

In some embodiments, the present invention encompasses a firearm that incorporates techniques facilitating convenient adjustment of the trigger shoe assembly without the need for complete disassembly of the firearm. Specifically, the set screw responsible for biasing the trigger bow into full engagement with the trigger shoe is strategically positioned and accessible from the top of the firearm when the slide is removed. This configuration allows shooters to make precise adjustments to the trigger shoe assembly without the necessity of disassembling the entire firearm. For example, consider a semi-automatic pistol equipped with this feature. When the shooter removes the slide of the pistol, typically accomplished by retracting the slide to its rearmost position and engaging the slide stop lever, the top rear portion of the trigger shoe becomes accessible. At this point, the set screw can be easily reached and adjusted using a suitable tool, such as a screwdriver or Allen wrench. By clockwise or counterclockwise rotation of the set screw, the pressure exerted on the trigger bow can be finely tuned, modifying the trigger shoe assembly's engagement and resulting trigger pull characteristics. This arrangement simplifies the adjustment process for shooters who desire to customize their trigger experience without requiring complete disassembly of the firearm. Instead of disassembling the entire pistol, which can be a time-consuming and complex procedure, accessing the set screw from the top of the firearm streamlines the adjustment process. This feature allows shooters to make quick and precise modifications to the trigger shoe assembly, enabling them to optimize their shooting experience according to personal preferences, competition requirements, or specific shooting scenarios.

In certain embodiments, the present invention pertains to a firearm incorporating techniques wherein the trigger shoe is designed in a dovetail shape. The dovetail shape of the trigger shoe offers distinct advantages in terms of secure installation, adjustable positioning, and compatibility with various firearm models and configurations. For example, consider a semi-automatic pistol that features a dovetail-shaped trigger shoe. The dovetail design enables the trigger shoe to be securely installed into a corresponding dovetail groove or slot in the firearm's frame. The geometry of the dovetail shape provides mechanical interlock and resistance against lateral movement, ensuring that the trigger shoe remains firmly in place during firearm operation. This robust installation method prevents unintended shifting or displacement of the trigger shoe, maintaining consistent trigger performance and reliability. Furthermore, the dovetail shape of the trigger shoe allows for adjustability. By selecting trigger shoes with different dovetail dimensions or by using shims, shooters can fine-tune the positioning of the trigger shoe to achieve their preferred trigger reach and finger placement. This adjustability accommodates shooters with varying hand sizes, grip preferences, and ergonomic needs, enhancing overall comfort and control during shooting. Moreover, the dovetail design of the trigger shoe promotes compatibility across different firearm models. Many firearms utilize a standardized dovetail groove for trigger shoe installation, allowing shooters to interchange trigger shoes between compatible firearms. This versatility enables shooters to personalize their trigger experience or transfer a preferred trigger shoe to different firearms within their collection, without the need for extensive modifications or customization.

In certain embodiments, the present invention encompasses a firearm incorporating techniques wherein the set screw responsible for biasing the trigger bow includes threading and a locking mechanism. This design allows the user to securely fix the desired position of the trigger bow relative to the trigger shoe, providing stability and preventing unintended movement during firearm operation. For example, consider a firearm equipped with this feature. The set screw, threaded to match the corresponding internal threads of the trigger shoe, enables the user to adjust the position of the trigger bow along the rear channel. By turning the set screw clockwise or counterclockwise, the user can control the amount of pressure exerted on the trigger bow, influencing the trigger shoe assembly's engagement and resulting trigger pull characteristics. Furthermore, the set screw incorporates a locking mechanism to ensure that once the desired position of the trigger bow is achieved, it remains securely fixed in place. This locking mechanism can be in the form of a locking nut, a threaded collar, or a specialized locking mechanism integrated into the set screw itself. When engaged, the locking mechanism prevents the set screw from unintentionally loosening due to recoil or other external forces, maintaining the desired position of the trigger bow. The threaded set screw with a locking mechanism provides shooters with a means to customize their trigger pull characteristics and maintain consistency over time. Once the ideal position of the trigger bow is determined, the locking mechanism can be tightened, effectively securing the set screw in place. This feature offers peace of mind to shooters, knowing that their desired trigger configuration will remain fixed and unchanged during shooting sessions or when transporting the firearm.

In certain embodiments, the present invention pertains to a firearm incorporating techniques wherein a spring-loaded detent mechanism is integrated within the trigger shoe assembly. This mechanism enhances the user experience by providing audible and tactile feedback, specifically when the front tab of the trigger bow is fully engaged within the rear channel of the trigger shoe. For example, consider a semi-automatic pistol featuring this spring-loaded detent mechanism. As the front tab of the trigger bow is inserted into the rear channel of the trigger shoe, the detent mechanism is compressed. Once the front tab reaches the fully engaged position, the detent mechanism is released, producing an audible click or snap sound and a tactile sensation that can be felt by the shooter's finger. The audible feedback serves as an indicator that the trigger shoe and trigger bow are securely and properly engaged. It provides confirmation to the shooter that the components are correctly aligned and ready for firing, increasing confidence in the firearm's operation. The tactile feedback further enhances the shooter's experience by providing a physical sensation of engagement. This feedback is particularly useful in situations where visual confirmation of the trigger engagement may be challenging, such as low-light conditions or when the shooter's focus is primarily on the target. The tactile sensation allows the shooter to verify the proper engagement of the trigger shoe and trigger bow without needing to visually inspect the firearm. By incorporating the spring-loaded detent mechanism into the trigger shoe assembly, the firearm provides an additional layer of reassurance and reliability. Shooters can trust that the trigger shoe and trigger bow are fully engaged and ready to deliver consistent and predictable trigger performance.

In various embodiments, the present invention encompasses a firearm incorporating techniques wherein the trigger shoe assembly is designed to be modular and interchangeable. This feature enables shooters to customize the trigger shoe assembly according to their preferences and provides compatibility with different firearm models, enhancing versatility and adaptability. For example, consider a modular rifle platform that allows users to interchange trigger shoe assemblies. The trigger shoe assembly consists of a removable trigger shoe and trigger bow unit that can be easily detached and replaced with another assembly. Each trigger shoe assembly may have distinct characteristics such as shape, size, texture, or trigger pull weight, offering shooters a range of options to suit their specific needs and shooting styles. By having a modular and interchangeable trigger shoe assembly, shooters can select trigger shoe units that optimize ergonomics, improve trigger feel, or meet specific shooting requirements. For instance, a shooter who prefers a wider trigger shoe with a textured surface may swap out the standard trigger shoe assembly for one that matches their preference. Likewise, a shooter participating in precision long-range shooting may choose a trigger shoe assembly with an adjustable trigger pull weight to fine-tune the trigger response. The modular nature of the trigger shoe assembly also allows for compatibility with different firearm models. By ensuring standardized dimensions and attachment methods, shooters can easily transfer their preferred trigger shoe assembly between firearms within the same platform or even across different models, saving time and effort in customization. Moreover, the modularity of the trigger shoe assembly facilitates easy maintenance and replacement. If a trigger shoe assembly becomes worn, damaged, or requires servicing, it can be quickly swapped out with a new assembly, eliminating the need for intricate repairs or complete firearm disassembly.

In certain embodiments, the present invention pertains to a firearm incorporating techniques wherein the trigger shoe is designed with a textured surface or grip enhancements. This feature enhances the shooter's control and comfort during trigger manipulation, resulting in improved overall shooting experience. For example, consider a semi-automatic pistol equipped with a trigger shoe featuring a textured surface. The texture can take the form of stippling, checkering, or other patterns that provide a tactile grip. When the shooter's finger engages the trigger shoe, the textured surface increases friction and grip, allowing for a more secure and controlled trigger pull. This improved grip helps prevent slipping or unintentional movement of the finger during firing, ensuring consistent and precise trigger manipulation.

In certain embodiments, the present invention pertains to a firearm incorporating techniques wherein the rear channel of the trigger shoe includes an integral alignment guide. This feature facilitates quick and accurate assembly of the trigger shoe assembly with the trigger bow, simplifying the process and ensuring proper alignment between the components. For example, consider a rifle equipped with this feature. The rear channel of the trigger shoe is designed with a built-in alignment guide, which includes ridges, grooves, or other protrusions that correspond to matching features on the trigger bow. When assembling the trigger shoe assembly, the alignment guide aids in aligning and positioning the trigger bow correctly within the rear channel. The integral alignment guide ensures that the trigger bow slides smoothly and precisely into place, reducing the likelihood of misalignment or the need for excessive adjustment. This feature saves time and effort during assembly, particularly in scenarios where quick maintenance, field stripping, or component replacement is required.

In some aspects, the techniques described herein relate to a firearm, wherein at least a portion of the trigger shoe assembly is fabricated from a steel alloy, a polymer, or a carbon fiber.

In some aspects, the techniques described herein relate to a firearm including: a frame; and a trigger shoe assembly operably connected to the frame, wherein the trigger shoe assembly includes: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

In certain embodiments, the present invention pertains to a firearm incorporating techniques wherein a trigger safety mechanism is integrated within the trigger shoe assembly. This mechanism serves to prevent accidental discharge of the firearm, enhancing safety during handling and operation. For example, consider a semi-automatic pistol featuring this trigger safety mechanism. The mechanism within the trigger shoe assembly is designed to engage a safety feature that blocks the trigger from moving and prevents it from being pulled unless intentionally disengaged. This additional layer of safety helps prevent accidental or unintended discharge of the firearm. The trigger safety mechanism can take various forms, such as a lever, button, or other components that are incorporated within the trigger shoe assembly. To disengage the safety and allow the trigger to be pulled, the shooter must actively and deliberately interact with the mechanism, typically by applying pressure or manipulating the safety feature.

In some aspects, the techniques described herein relate to a firearm, wherein the front tab of the trigger bow includes a reinforced metal insert, increasing strength and wear resistance at the engagement point with the rear channel of the trigger shoe.

In certain embodiments, the present invention encompasses a firearm that incorporates techniques wherein an adjustable trigger pull weight mechanism is integrated into the set screw. This mechanism allows users to customize the trigger pull force according to their preference, providing a personalized shooting experience. For example, consider a handgun equipped with this adjustable trigger pull weight mechanism. The set screw responsible for biasing the trigger bow into engagement with the trigger shoe includes an innovative design that enables precise control over the trigger pull force. By turning the set screw clockwise or counterclockwise, shooters can increase or decrease the tension applied to the trigger bow, thereby adjusting the trigger pull weight. The adjustable trigger pull weight mechanism provides shooters with the ability to tailor the trigger pull to their liking, accommodating individual preferences, shooting styles, and shooting scenarios. Some shooters may prefer a lighter trigger pull weight for enhanced precision shooting, while others may opt for a slightly heavier pull for added safety and control. By offering adjustability, the firearm caters to a wide range of shooter preferences and allows for fine-tuning the trigger to achieve optimal performance.

In some aspects, the techniques described herein relate to a firearm further including a trigger reset mechanism in the trigger shoe assembly, providing audible and tactile feedback to the shooter when the trigger is ready for subsequent firing.

In some aspects, the techniques described herein relate to a firearm, wherein at least a portion of the trigger shoe assembly is fabricated from a steel alloy, a polymer, or a carbon fiber.

In some aspects, the techniques described herein relate to a firearm, wherein the trigger shoe assembly includes one or more interchangeable trigger shoes.

In some aspects, the techniques described herein relate to a firearm, wherein the trigger shoe includes a textured surface or grip enhancements, improving the shooter's control and comfort during trigger manipulation.

In some aspects, the techniques described herein relate to a firearm, wherein the trigger shoe assembly is modular and interchangeable, allowing for customization and compatibility with different firearm models or user preferences.

In some aspects, the techniques described herein relate to a trigger shoe assembly including: a trigger shoe having a back portion defining a rear channel; a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

Although embodiments of the present invention have been described herein in the context of a particular implementation in a particular environment for a particular purpose, those skilled in the art will recognize that its usefulness is not limited thereto and that the embodiments of the present invention can be beneficially implemented in other related environments for similar purposes. The invention should therefore not be limited by the above described embodiments, method, and examples, but by all embodiments within the scope and spirit of the invention as claimed.

Further, it is to be understood that the terminology used herein is for the purpose of describing particular embodiments only and is not intended to be limiting. The terms "a" or "an" as used herein, are defined as one or more than one. The term "plurality" as used herein, is defined as two or more than two. The term "another" as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper," "lower," "left," "rear," "right," "front," "vertical," "horizontal," and derivatives thereof relate to the invention as oriented in the figures and is not to be construed as limiting any feature to be a particular orientation, as said orientation may be changed based on the user's perspective of the device.

In the invention, various embodiments have been described with references to the accompanying drawings. It may, however, be evident that various modifications and changes may be made thereto, and additional embodiments may be implemented, without departing from the broader scope of the invention as set forth in the claims that follow. The invention and drawings are accordingly to be regarded in an illustrative rather than restrictive sense.

The invention is not to be limited in terms of the particular embodiments described herein, which are intended as illustrations of various aspects. Many modifications and variations can be made without departing from its spirit and scope. Functionally equivalent systems, processes and apparatuses within the scope of the invention, in addition to those enumerated herein, may be apparent from the representative descriptions herein. Such modifications and variations are intended to fall within the scope of the appended claims. The invention is to be limited only by the terms of the appended claims, along with the full scope of equivalents to which such representative claims are entitled.

The preceding description of exemplary embodiments provides non-limiting representative examples referencing numerals to particularly describe features and teachings of different aspects of the invention. The embodiments described should be recognized as capable of implementation separately, or in combination, with other embodiments from the description of the embodiments. A person of ordinary skill in the art reviewing the description of embodiments should be able to learn and understand the different described aspects of the invention. The description of embodiments should facilitate understanding of the invention to such an extent that other implementations, not specifically covered but within the knowledge of a person of skill in the art having read the description of embodiments, would be understood to be consistent with an application of the invention.

What is claimed is:

1. A firearm comprising:

a slide assembly;

a barrel;

a frame; and a trigger shoe assembly comprising:

a trigger shoe having a back portion defining a rear channel;

a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

2. The firearm of claim 1, wherein the set screw accessible from a top of the firearm when the slide of the firearm is removed, thereby facilitating adjustment of the trigger shoe assembly without requiring complete disassembly of the firearm.

3. The firearm of claim 1, wherein the trigger shoe is dovetail shaped.

4. The firearm of claim 1, wherein the set screw is threaded and includes a locking mechanism, enabling the user to securely fix the desired position of the trigger bow relative to the trigger shoe.

5. The firearm of claim 1, wherein the firearm further comprises a spring-loaded detent mechanism incorporated within the trigger shoe assembly, providing audible and tactile feedback when the front tab of the trigger bow is fully engaged within the rear channel of the trigger shoe.

6. The firearm of claim 1, wherein the trigger shoe assembly is modular and interchangeable, allowing for customization and compatibility with different firearm models or user preferences.

7. The firearm of claim 1, wherein the trigger shoe includes a textured surface or grip enhancements, improving the shooter's control and comfort during trigger manipulation.

8. The firearm of claim 1, wherein the rear channel of the trigger shoe includes an integral alignment guide, facilitating quick and accurate assembly of the trigger shoe assembly with the trigger bow.

9. The firearm of claim 1, wherein at least a portion of the trigger shoe assembly is fabricated from a steel alloy, a polymer, or a carbon fiber.

10. A firearm comprising:

a frame; and a trigger shoe assembly operably connected to the frame, wherein the trigger shoe assembly comprises:

a trigger shoe having a back portion defining a rear channel;

a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

11. The firearm of claim 10, wherein the trigger shoe is dovetail shaped.

12. The firearm of claim 10, wherein the firearm further comprises a trigger safety mechanism incorporated within the trigger shoe assembly, preventing accidental discharge of the firearm.

13. The firearm of claim 10, wherein the front tab of the trigger bow comprises a reinforced metal insert, increasing strength and wear resistance at the engagement point with the rear channel of the trigger shoe.

14. The firearm of claim 10 further comprising an adjustable trigger pull weight mechanism integrated into the set screw, allowing users to customize the trigger pull force to their preference.

15. The firearm of claim 10 further comprising a trigger reset mechanism in the trigger shoe assembly, providing audible and tactile feedback to the shooter when the trigger is ready for subsequent firing.

16. The firearm of claim 10, wherein at least a portion of the trigger shoe assembly is fabricated from a steel alloy, a polymer, or a carbon fiber.

17. The firearm of claim 10, wherein the trigger shoe assembly comprises one or more interchangeable trigger shoes.

18. The firearm of claim 10, wherein the trigger shoe includes a textured surface or grip enhancements, improving the shooter's control and comfort during trigger manipulation.

19. The firearm of claim 10, wherein the trigger shoe assembly is modular and interchangeable, allowing for customization and compatibility with different firearm models or user preferences.

20. A trigger shoe assembly comprising:

a trigger shoe having a back portion defining a rear channel;

a trigger bow having a front tab configured to be received by the rear channel, wherein the front tab and rear channel define corresponding angled surfaces facilitating seating of the front tab within the rear channel, the rear channel terminating at a lip engaging with a notch of the front tab for full engagement of the trigger shoe with the trigger bow; and a set screw biasing the trigger bow into full engagement with the trigger shoe, wherein the set screw extends vertically through a top rear portion of the trigger shoe and engages a top portion of the front tab of the trigger bow.

* * * * *